US008029963B2

(12) United States Patent
Almog et al.

(10) Patent No.: US 8,029,963 B2
(45) Date of Patent: Oct. 4, 2011

(54) METHOD FOR CHARGING TONER PARTICLES

(75) Inventors: Yaacov Almog, Nes Ziona (IL); Avi Koller, Rehovot (IL); Yaffa Israeli, Tel Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 783 days.

(21) Appl. No.: 11/916,650

(22) PCT Filed: Jun. 6, 2005

(86) PCT No.: PCT/IL2005/000594

§ 371 (c)(1),
(2), (4) Date: Jun. 12, 2008

(87) PCT Pub. No.: WO2006/131905

PCT Pub. Date: Dec. 14, 2006

(65) Prior Publication Data

US 2009/0220884 A1 Sep. 3, 2009

(51) Int. Cl.
*G03G 9/097* (2006.01)

(52) U.S. Cl. ..... 430/115; 430/119.5; 430/137.22

(58) Field of Classification Search ..... 430/115, 430/119.5, 137.22
See application file for complete search history.

(56) References Cited

U.S. PATENT DOCUMENTS

| | | | | |
|---|---|---|---|---|
| 4,879,197 | A * | 11/1989 | Kohmura et al. | 430/119.5 |
| 5,935,755 | A * | 8/1999 | Kazmaier et al. | 430/123.5 |
| 5,942,365 | A * | 8/1999 | Gibson et al. | 430/115 |
| 2008/0163789 | A1 * | 7/2008 | Silcoff et al. | 106/31.6 |

FOREIGN PATENT DOCUMENTS

| | | |
|---|---|---|
| EP | 0 435 129 | 7/1991 |
| EP | 0 609 003 | 8/1994 |
| EP | 0 807 859 | 11/1997 |
| GB | 1 411 739 | 10/1975 |
| GB | 1 448 350 | 10/1975 |
| WO | WO 2005/040935 | 5/2005 |

* cited by examiner

*Primary Examiner* — Mark F Huff
*Assistant Examiner* — Rashid Alam

(57) ABSTRACT

A charge adjuvant for promoting charging of toner particles comprising a dielectric carrier liquid; and an organic aluminum salt dissolved in the liquid, said organic aluminum salt being soluble in the carrier liquid at room temperature is disclosed. Also disclosed are solutions of the charge adjuvant with a charge director, a method of producing toner utilizing the charge adjuvant and a liquid toner.

25 Claims, 2 Drawing Sheets

METHOD FOR CHARGING TONER PARTICLES

FIELD OF THE INVENTION

The present invention relates to the process of producing liquid toners for use in electrostatic printing and in particular to charging toner particles comprised in the toner.

BACKGROUND OF THE INVENTION

To print an image on an appropriate substrate, a typical "electrostatic" digital printer first forms a copy of the image, conventionally referred to as a "latent image", on a photosensitive surface of a cylindrical roller, hereinafter referred to as a "photosensitive imaging plate" (PIP). To form the latent image a charger deposits a substantially uniform charge density on the photosurface. A laser then scans the charged photosensitive surface and discharges regions thereon to generate a pattern of charged and discharged, or partially discharged, pixels on the photosurface that forms the latent image and replicates the image to be printed.

A developer electrode is used to develop the latent image by applying ink or toner, hereinafter generically, toner, to the photosensitive surface. The toner comprises charged toner particles of a desired color, which adhere to the charged or the discharged or partially discharged pixels, depending on the details of the printing process used. The toner on the PIP is then optionally transferred from the PIP to a suitable transfer surface of another roller, conventionally referred to as an "intermediate transfer member" (ITM). The toner is transferred from the ITM (or the PIP, if no ITM is used) to the substrate, to print the image when the substrate passes through a nip between the ITM and an impression roller. In some cases the toner is transferred directly from the PIP to the substrate without an intermediate transfer via the ITM.

In many printing processes the toner is a liquid toner comprising charged toner particles dispersed in a non-polar carrier liquid having a relatively high electrical resistance. The toner particles generally comprise a polymer in which, optionally, a pigment is dispersed. In order for the toner particles to be properly electrophoretically transferred and adhered to the PIP, and optionally to the ITM or to the substrate, the toner particles are charged with an amount of charge that endows them with an appropriate mobility. Charging is generally accomplished by adding to the particles at least one charge control agent, alternatively referred to as a "charge director" (CD), which usually comprises organic salt or zwitterionic molecules.

A charge priming agent, conventionally referred to as a charge adjuvant (CA), that promotes charging of the toner particles by the charge director is also often added to the particles. For liquid toners, aluminum alkoxide, or a metallic soap, for example, magnesium stearate, aluminum tristearate or octoate, are commonly used as a charge adjuvant.

Some of the commonly used CAs, such as aluminum or magnesium stearate, are relatively insoluble at room temperature in carrier liquids typically used for liquid toners. To provide for effective activity of these CAs, they are generally added to a toner during production when toner ingredients are ground together so that the grinding process can thoroughly mix the CAs with the toner ingredients and optionally, react with them. However, because these CAs must in general be ground together with toner ingredients, they cannot usually be added to a toner after production to adjust for deviation of toner particle charge from a desired normative charge or to reverse or moderate dissipation of toner charge that may occur during the shelf life of the toner.

Some CAs, such as the aluminum alkoxides (which are the reaction product of a metal and an appropriate alcohol), are practically soluble in toner carrier liquids. However, these CAs tend to be highly reactive not only with toner ingredients but also with impurities, in particular water, that typically adulterate liquid toners. They tend to generate charge not only on toner particles, but to add to "parasitic" charge in the carrier liquid by interacting with the charge director and molecules in the carrier liquid that are not associated with the toner particles to generate charged molecular species. The parasitic charge contributes to background "parasitic conductivity" of the toner that tends to degrade quality of an image printed with the toner. In addition, the particular affinity of these CAs to water often results in their undergoing hydrolysis and precipitating out of a toner dispersion to which they are added. As a result, it is generally difficult to provide consistent and controllable levels of toner particle charging with these CAs.

U.S. Pat. Nos. 4,794,651 and 5,565,299 describe materials and processes for preparing a liquid toner. U.S. Pat. Nos. 4,707,429 and 5,225,306 describe materials and processes for preparing a liquid toner using an aluminum tri-stearate charge adjuvant and aluminum alkoxide charge priming agent (Isopar soluble CA). U.S. Pat. No. 5,573,882 describes materials and processes for preparing a liquid toner using a charge adjuvant. U.S. Pat. No. 5,393,635 describes a negative charge director for liquid electrographic toners in which a negative charge is generated by a weakly associating charged functional group covalently bonded to the resin of the toner particles and a very strongly chelating molecule dispersed in the liquid phase to achieve charge separation. The disclosures of all the aforementioned U.S. patents are incorporated herein by reference.

SUMMARY OF THE INVENTION

An aspect of some embodiments of the invention relates to providing a charge adjuvant (CA), which when added to a liquid toner improves effectiveness of a charge director comprised in charging toner particles in the toner.

An aspect of some embodiments of the invention relates to providing a CA that can be added to a toner after toner production to allow for the adjustment of the charge level of the toner on a batch by batch basis. It is believed that the charge adjuvants in accordance with embodiments of the invention can be used to enhance toner particle charge that might have dissipated during the shelf life of the toner.

An aspect of some embodiments of the invention is the provision, in a liquid toner, of a charge director that comprises an organic metal salt.

An aspect of some embodiments of the invention relates to providing a CA that is relatively highly soluble in the toner carrier liquid at room temperature and can be used to provide consistent and controllable levels of toner particle charging relative to prior art CAs that are soluble in the carrier liquid.

In accordance with an embodiment of the invention, the charge adjuvant exhibits relatively low reactivity with charge director molecules and impurities that typically contaminate liquid toners.

The solubility of the adjuvant in the carrier liquid is believed to provide for increased contact between charge adjuvant molecules and toner particles and enhances efficacy of the adjuvant molecules in modifying the toner particles so that the charge director more readily charges them. Optionally, the solubility of the adjuvant in the carrier liquid is greater than 2% by weight (w/w) of the carrier liquid. Optionally the solubility is greater than 3% w/w. Optionally, the solubility is greater than or equal to 5% or 10% w/w.

In an embodiment of the invention, the solubility is great enough so that the total amount of charge adjuvant that is used can be substantially all dissolved in the carrier liquid at room temperature, in the absence of toner particles. As used herein, the term "high solubility" means a solubility at this level or greater.

The relatively low reactivity of the adjuvant with charge director and impurity molecules reduces a tendency of the adjuvant to react with the charge director and/or impurities in processes that compete with charging of toner particles, decrease reactivity of the adjuvant with the toner particles and amplify parasitic background conductivity of the toner. The low reactivity can be measured by mixing a CD solution in Isopar with soluble adjuvant in the range which is used for charge enhancement. If the increase in conductivity is below 25% of the original conductivity in the CD solution, then the interaction is considered "low". This increase is caused by a (small) increase due to the dissolved salt and the change in the charge director caused by reaction with the adjuvant. While commonly this reaction causes an increase in the conductivity, for some charge directors the reaction may cause a decrease in conductivity. In either event, an change of more than 25% in either direction would indicate an undesirable level of interaction. Less would generally be considered "substantially non-reactive."

Also, as a result of the solubility of the adjuvant in the carrier liquid and its relatively low reactivity with the charge director, the adjuvant is effective in improving toner particle chargeability substantially independent of when it is added to the toner. The adjuvant may not only be added, as is done conventionally, during grinding of the toner, but may also be added, with substantially a same effectiveness in abetting charging of toner particles in the toner, after the toner particles are produced and/or after the charge director is added to the toner. Optionally, at least some of the charge adjuvant is added to the toner together with the charge director, for example they are both dissolved in a quantity of carrier liquid and the solution is added to the dispersion of toner particles in carrier liquid.

As a result, selective quantities of the CA can be added to different batches of a toner after they are produced to moderate deviations in the charging level of toner particles in the batches from a desired charging level.

Selective quantities of the CA may also be added to a toner to moderate charge dissipation of toner particles that might occur during the shelf life of the toner. The inventors believe that adding suitable quantities of the CA can substantially completely reverse such charge dissipation.

In some embodiments of the invention, the carrier liquid is an isoparaffin such as Isopar-L (Isoparaphinic synthetic liquid) manufactured by EXXON, or a mixture of Isopar and Marcol 82 (EXXON) as known in the art and the salt is an Isopar soluble aluminum salt. The inventors have synthesized aluminum salts belonging to the family of aluminum sulfosuccinates, which may be used as charge adjuvants that have relatively high solubility in Isopar at room temperatures and relatively low reactivity with charge directors typically used to charge toner particles in a liquid toner. The inventive adjuvants also have relatively low reactivity with impurities such as water that typically contaminate liquid toners. Optionally, the salt comprises a salt from the group consisting of $Al(OT)_3$ (aluminum tri bis(2-ethylhexyl) sulfosuccinate), $Al(TR)_3$ aluminum tri (di-tridecylsulfosuccinate) and $Al(DDBS)_3$ (aluminum tri dodecyl benzene sulfonate). Of the above materials, $Al(OT)_3$ is the most efficient. The level of charging achieved by $Al(OT)_3$ is about as twice that achieved when $Al(DDBS)_3$ is used as the additive. $Al(TR)_3$ is about 15% more effective (than $Al(DDBS)_3$). The salts in the group exhibit solubility greater than about 5% w/w in Isopar. Optionally, the charge director comprises at least one of basic barium petronate (BBP), calcium petronate and/or a zwitterionic material, such as lecithin. Since the adjuvant is believed to act on the receptors for the charge director on the polymer that makes up the bulk of the toner particles, the charge adjuvants are believed to be generally effective as adjuvants for a wide range of charge directors There is thus provided, in accordance with an embodiment of the invention, a charge adjuvant for promoting charging of toner particles comprising:

a dielectric carrier liquid; and an organic aluminum salt dissolved in the liquid, said organic aluminum salt being soluble in the carrier liquid at room temperature.

In an embodiment of the invention, the aluminum salt comprises an aluminum sulfosuccinate. Optionally the salt comprises at least one salt from the group of salts consisting of $Al(OT)_3$ (aluminum bis(2-ethylhexyl) sulfosuccinate) $Al(TR)_3$ (aluminum tri di-tridecylsulfosuccinate) and $Al(DDBS)_3$ (aluminum dodecyl benzene sulfonate).

In an embodiment of the invention, the dielectric carrier liquid is a liquid hydrocarbon, optionally an isoparaffin.

In various embodiments of the invention, the salt has a solubility in the carrier liquid greater than or equal to 2%, 3% or 5% w/w.

There is further provided, in accordance with an embodiment of the invention, a solution comprising:

a charge adjuvant according to the invention; and a charge director dissolved in the dielectric carrier liquid.

In an embodiment of the invention, the charge director comprises at least one of the group consisting of basic barium petronate (BBP), calcium petronate and a zwitterionic material. Optionally, the zwitterionic material comprises lecithin.

There is further provided, in accordance with an embodiment of the invention a method of charging toner particles in a liquid toner comprising toner particles dispersed in a carrier liquid, the method comprising:

adding a charge director to the toner; and adding an organic aluminum salt that is soluble in the carrier liquid as a charge adjuvant to the toner.

In an embodiment of the invention, the aluminum salt comprises an aluminum sulfosuccinate. Optionally the salt comprises at least one salt from the group of salts consisting of $Al(OT)_3$ (aluminum bis(2-ethylhexyl) sulfosuccinate) $Al(TR)_3$ (aluminum tri di-tridecylsulfosuccinate) and $Al(DDBS)_3$ (aluminum dodecyl benzene sulfonate).

In an embodiment of the invention, the dielectric carrier liquid is a liquid hydrocarbon, optionally an isoparaffin.

In an embodiment of the invention, the salt is highly soluble in the carrier liquid.

In various embodiments of the invention, the salt has a solubility in the carrier liquid greater than or equal to 2%, 3% or 5% w/w.

In an embodiment of the invention, the charge director comprises at least one of the group consisting of basic barium petronate (BBP), calcium petronate and a zwitterionic material. Optionally, the zwitterionic material comprises lecithin.

In various embodiments of the invention, the charge adjuvant is added in one or more of the following ways (1) after the charge director, (2) before the charge director and together with the charge director. Alternatively or additionally, the adjuvant is added after an initial charge generated on the toner particles has dissipated.

There is further provided, in accordance with an embodiment of the invention, a liquid toner comprising:

a dielectric carrier liquid;

toner particles that have been reacted with an organic aluminum salt that is soluble in the carrier liquid at room temperature; and a charge director, wherein the aluminum salt is effective to increase the chargeability of the toner particles by the charge director.

In an embodiment of the invention, the aluminum salt comprises an aluminum sulfosuccinate. Optionally the salt comprises at least one salt from the group of salts consisting of $Al(OT)_3$ (aluminum bis(2-ethylhexyl) sulfosuccinate) $Al(TR)_3$ (aluminum tri di-tridecylsulfosuccinate) and $Al(DDBS)_3$ (aluminum dodecyl benzene sulfonate).

In an embodiment of the invention, the dielectric carrier liquid is a liquid hydrocarbon, optionally an isoparaffin.

In an embodiment of the invention, the salt is highly soluble in the carrier liquid.

In various embodiments of the invention, the salt has a solubility in the carrier liquid greater than or equal to 2%, 3% or 5% w/w.

In an embodiment of the invention, the charge director comprises at least one of the group consisting of basic barium petronate (BBP), calcium petronate and a zwitterionic material. Optionally, the zwitterionic material comprises lecithin.

BRIEF DESCRIPTION OF THE DRAWINGS

Exemplary embodiments of the invention are described below with reference to the attached figures, which show experimental results which illustrate the effect of an exemplary embodiment of the invention. The drawings are.

DETAILED DESCRIPTION OF EXEMPLARY EMBODIMENTS

Figure 1:
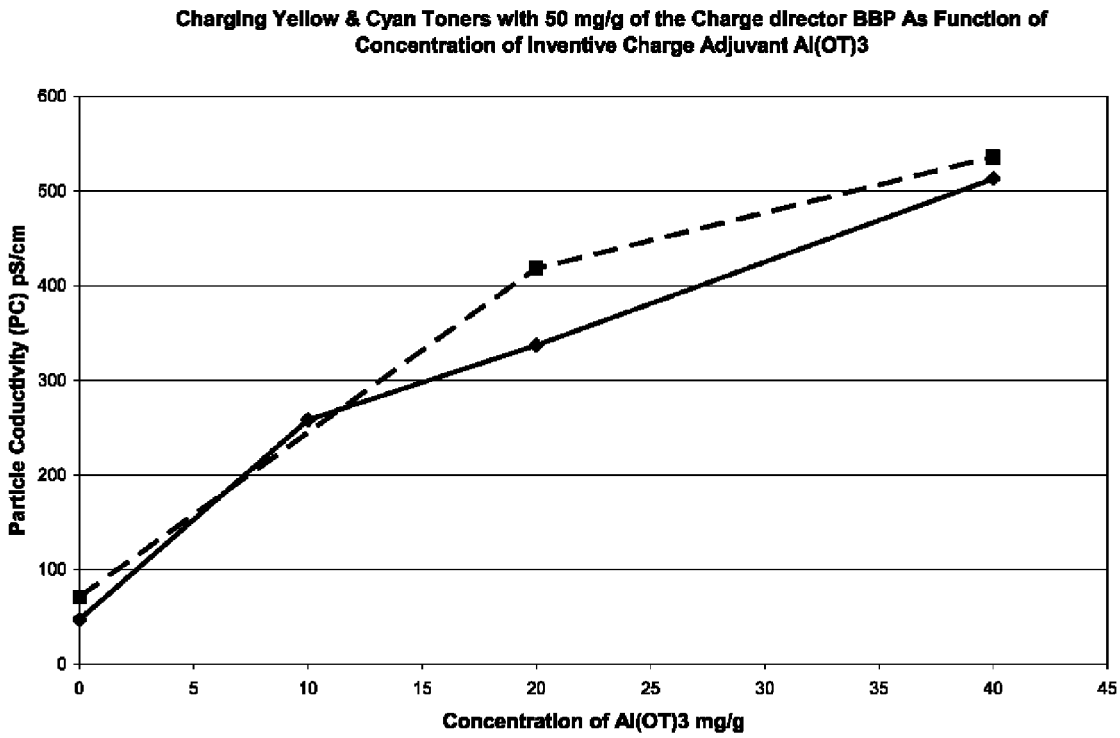
FIG. 1 shows the effect of changes in concentration of $Al(OT)_3$ on particle conductivity for constant concentration of charge director.

A liquid toner for which toner particles comprised therein are to be charged in accordance with an embodiment of the invention may be prepared using any of various methods known in the art. Typically, a thermoplastic polymer, such as, optionally, Nucrel 699 resin, (Ethylene—methacrylic acid copolymer) manufactured by Du Pont, is mixed with a carrier liquid, for example Isopar-L (Isoparaphinic synthetic liquid) manufactured by EXXON, at elevated temperature (e.g. 120° C.-130° C.) to form a slurry of the carrier liquid and polymer toner particles plasticized with the carrier liquid. The slurry is allowed to cool while mixing and carrier liquid is generally added to dilute the slurry so that it comprises, for example, between 10-23% by weight of solids. While cooling it is precipitated in a form of paste. Pigments or dyes are, optionally, added to provide the toner particles with a desired color and the mixture is loaded into a ball mill and ground starting at a temperature of about 60° C. and being reduced to room temperature, generally for about 20 hours, until the toner particles have a desired size distribution and are appropriately percolated by the pigment.

In some embodiments of the invention, a charge adjuvant that has relatively high solubility in Isopar L and relatively low reactivity with a charge director used to charge the toner particles is added to the toner during grinding. In some embodiments of the invention, the charge adjuvant is not added during grinding but is added after the toner has been produced and already comprises the charge director. In some embodiments of the invention, the charge adjuvant is an aluminum salt belonging to the family of aluminum sulfosuccinates. Optionally, the salt comprises at least one salt chosen form the group consisting of $Al(OT)_3$, $Al(TR)_3$, and $Al(DDBS)_3$. The salts in the group exhibit solubility greater than about 5% by weight in Isopar-L.

Following grinding, the liquid toner is allowed to cool to room temperature, and a charge director is added and mixed to percolate the charge director through the toner. In some embodiments of the invention, the charge director comprises molecules of at least one of basic barium petronate, calcium petronate, and a zwitterionic material such as lecithin. The toner is then left to sit for a sufficient period for the charge director to charge the toner particles.

The resulting toner generally comprises a relatively high concentration of non-volatile solids and is diluted with additional quantities of Isopar as may be needed for storage or printing. For storage, the toner may be diluted to about 20% by weight of non-volatile solids (NVS). Immediately prior to use, the concentrate is typically diluted with additional carrier liquid to a concentration of about 1% to about 2.5% by weight of NVS.

The inventors have produced exemplary yellow and cyan toners in which the toners were charged with BBP as charge director and the aluminum sulfosuccinate salt, $Al(OT)_3$, was used as a charge adjuvant, in accordance with embodiments of the invention. Quantities of $Al(OT)_3$ for the exemplary toners were produced in processes similar to that described below by converting commercially available sodium salt, NaOT, to an acid derivative and converting the derivative to a corresponding potassium salt. The potassium salt is reacted with aluminum nitrate to provide the aluminum sulfosuccinate.

By way of example, a quantity of $Al(OT)_3$ was produced by first dissolving five grams of NaOT (0.011 mol) in 100 ml of ethanol for about 20 minutes and filtering the resultant solution to remove traces of $Na_2CO_3$. About 0.55 g of concentrated $H_2SO_4$ (0.0055 mol) were diluted in 30 ml of diethyl ether and added, drop wise at room temperature, to the NaOT solution over a period of about 10 minutes. The solution was then stored in the freezer for 15 hours during which $Na_2SO_4$ precipitated out of the solution. The precipitates were filtered off and the resultant solution titrated with 1 mol of KOH in methanol, until a change in pH of the solution indicated that the solution had changed from acidic to basic and that titration was substantially complete. The resultant titrates, which included K-OT, were purified by evaporating the methanol and dissolving the resultant solids in ether. Salts insoluble in the ether were filtered off and the solution was tested with potassium iodide paper to determine if it was contaminated with peroxides. The ether was then evaporated to leave K-OT. The process yield was about 95%.

About 0.538 g of $Al(NO_3)_3*9H_2O$ (0.00143 mol, ⅓ equivalent of K-OT), were dissolved in 30 ml of absolute ethanol. The $Al(NO_3)_3$ solution was added slowly to a solution of about 2 g of K-OT (0.0043 mol), prepared as described above, in about 50 ml of ethanol maintained at a temperature of about 60° C. in an oil bath. After stirring at 60° C. for about 2 hours, the solution was stirred for a further 12 hours during which the solution cooled to room temperature. Insoluble salts formed by the reactants in the solution were then filtered off and the ethanol evaporated. Diethyl ether was added to the resultant residue and the solution filtered to remove potassium nitrate. The diethyl ether solution was tested with KI paper to assure that it was not contaminated with peroxides and the diethyl ether evaporated. The resultant residue was dissolved in 50 ml of hexane and left to stand in a refrigerator for about 15 hours. The cooled solution was filtered to remove any residual undissolved potassium nitrate and the hexane evaporated to leave a resultant residue of $Al(OT)_3$. A procedure in which the residue was dissolved in toluene and the toluene evaporated was repeated twice to remove traces of water and alcohol from the $Al(OT)_3$. The resultant $Al(OT)_3$ (which was produced with a process yield of about 95%) was dissolved in Isopar-L to form a "charge adjuvant solution" of about 5% w/w $Al(OT)_3$ in Isopar. ICP analysis showed level of purity >90%.

For each exemplary toner, a concentrate of the toner in which non-volatile solids accounted for about 10% by weight, was produced using a suitable pigment and a toner production process similar to that described above. The concentrate was produced from a neutral "base" toner prepared by first mixing 7.5 kg of Nucrel 699 (du Pont) and 7.5 kg of Isopar L (Exxon) in a Ross double planetary mixer for about 1 hour at speed 2 and a temperature of about 150° C. A quantity of about 15 kg of Isopar preheated to about 90° C. was then added and the mixture mixed for another 1 hour at speed 5. The resultant mixture was cooled to room temperature during continued mixing at speed 3.

The yellow toner concentrate was produced by adding 52.9 g Paliotol yellow D1155 (BASF), 13.3 g Paliotol D 1819 (BASF) and 661 g Isopar L to 1573 g of the base toner and grinding the mixture in an S1 attritor (Union process, Akron, Ohio) for 20 hours at 250 rpm. The cyan toner concentrate was produced by adding 85.3 g Permanent carmine PBB02 (Clariant), 11.8 g Quindo magenta (Bayer) and 753 g Isopar L to 1594 g of the base toner and grinding the mixture in an S1 attritor for 20 hours at 250 rpm.

For each of the exemplary yellow and cyan toners quantities of the charge director BBP and the $Al(OT)_3$ solution were added to the concentrate of the toner and mixed in a shaker. The toner was then allowed to sit for a charging period, "TC", of 48 hours during which charge accumulated on toner particles in the toner and stabilized. The toner was subsequently diluted with Isopar L to an NVS concentrate of about 2% w/w. Particle conductivity (PC), of the diluted toner ascribed to charge accumulated by toner particles resulting from activity of the charge director and charge adjuvant was then measured.

FIG. 1 shows a graph of the measured particle conductivities (PC) for the yellow and cyan toners charged with BBP at a concentration of 50 mg/g of NVS and concentrations of $Al(OT)_3$ in a range from 0 to about 40 mg/g NVS. In the graph concentration of $Al(OT)_3$ is given along the abscissa and corresponding PCs are given in pS/cm along the ordinate. Square marker icons indicate PC measurements acquired for the cyan toner. The icons are connected with dashed lines. Diamond marker icons indicate PC measurements acquired for the yellow toner. The diamond marker icons are connected by solid lines.

The graph shows that, for both toners, the addition of $Al(OT)_3$ markedly improves PC. For the yellow toner, PC is improved by a factor of about 10 (from a PC equal to about 50 to a PC equal to about 510) over the range of concentrations of $Al(OT)_3$ shown in the graph. For the cyan toner, PC improves by a factor equal to about 7.6 (from a PC equal to about 70 to a PC equal to about 536) over the $Al(OT)_3$ concentration range. For both toners, PC increases at an average rate of about 40 pS/cm per 10 mg/g increase in concentration of $Al(OT)_3$ over the concentration range of $Al(OT)_3$ shown.

Figure 2:
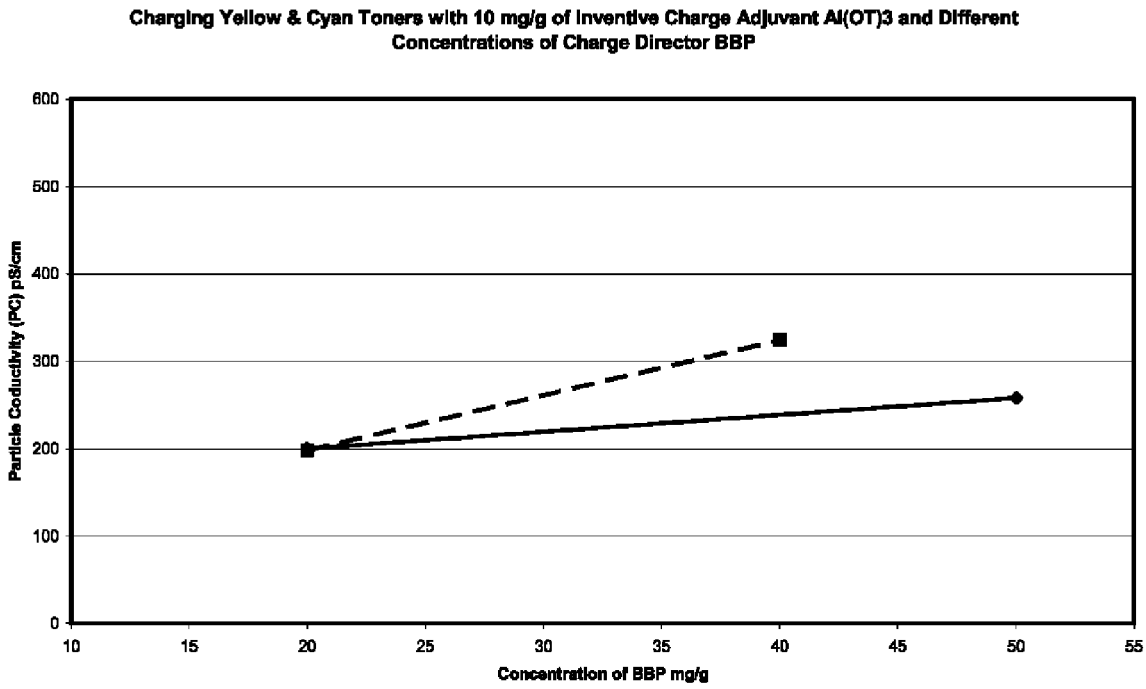
FIG. 2 shows the effect of changes in concentration of charge director on particle conductivity for a constant concentration of $Al(OT)_3$.

FIG. 2 shows a graph of change in PC in the yellow and cyan toners as a function of change in concentration of BBP for a fixed concentration of $Al(OT)_3$ equal to about 10 mg/g. In the graph of FIG. 2, as in the graph of FIG. 1, square marker icons and dashed trend line refer to the cyan toner and diamond marker icons and dashed trend line refer to the cyan toner. For the cyan toner PC measurements were acquired for BBP concentrations equal to 20 mg/g and 40 mg/g and for the yellow toner PC measurements were acquired for 20 mg/g and 50 mg/g concentrations of BBP. From FIG. 2 it is readily evident that for the range of BBP concentrations shown in the graph, change in concentration of BBP is substantially less effective in producing a change in PC.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. For example, the embodiments described above utilize hydrocarbon liquids, which are presently used for all or almost all liquid toners. However, since the charge adjuvants of the invention act on the toner particles, it is believed that the present invention is applicable to liquid toners utilizing different dielectric liquids, such as silicone oils as a carrier liquid. The scope of the invention is limited only by the following claims.

The invention claimed is:

1. A liquid toner comprising:
a dielectric carrier liquid;
toner particles;
charge director; and
a charge adjuvant for promoting charging of toner particles by said charge director, the charge adjuvant comprising an organic aluminum salt dissolved in the liquid, said organic aluminum salt comprising aluminum sulfosuccinate and is soluble in the carrier liquid at room temperature.

2. A liquid toner according to claim 1 wherein the salt comprises at least one salt from the group of salts consisting of $Al(OT)_3$ (aluminum bis(2-ethylhexyl) sulfosuccinate) and $Al(TR)_3$ (aluminum tri ditridecylsulfosuccinate).

3. A liquid toner according to claim 2 wherein the salt comprises aluminum bis(2-ethylhexyl) sulfosuccinate.

4. A liquid toner according to claim 2 wherein the dielectric carrier liquid is a liquid hydrocarbon.

5. A liquid toner according to claim 4 wherein the liquid hydrocarbon is an isoparaffin.

6. A liquid toner according to claim 1 wherein the salt has a solubility in the carrier liquid greater than or equal to 2% w/w.

7. A liquid toner according to claim 1 wherein the salt has a solubility in the carrier liquid greater than or equal to 5% w/w.

8. A liquid toner according to claim 1, wherein the charge director comprises at least one of the group consisting of basic barium petronate (BBP), calcium petronate and a zwitterionic material.

9. A liquid toner according to claim 8 wherein the zwitterionic material comprises lecithin.

10. A method of charging toner particles in a liquid toner comprising toner particles dispersed in a carrier liquid, the method comprising:

adding a charge director to the toner; and adding an organic aluminum salt that is soluble in the carrier liquid as a charge adjuvant to the toner, wherein the aluminum salt comprises an aluminum sulfosuccinate, in which the charge adjuvant is added to the toner after the charge director.

11. A method according to claim 10 wherein the salt comprises at least one salt from the group of salts consisting of aluminum bis(2-ethylhexyl) sulfosuccinate and aluminum tri di-tridecylsulfosuccinate.

12. A method according to claim 11 wherein the salt comprises aluminum bis(2-ethylhexyl) sulfosuccinate.

13. A method according to claim 10 wherein the salt has a solubility in the carrier liquid greater than or equal to about 2% w/w.

14. A method according to claim 10 wherein the salt has a solubility in the carrier liquid greater than or equal to about 3% w/w.

15. A method according to claim 10 wherein the charge director comprises at least one of the group consisting of basic barium petronate (BBP), calcium petronate and a zwitterionic material.

16. A method according to claim 15 wherein the zwitterionic material comprises lecithin.

17. A method according to claim 10 wherein charge adjuvant is added before the charge director.

18. A method according to claim 10 wherein charge adjuvant is added together with the charge director.

19. A method according to claim 10 wherein the adjuvant is added after an initial charge generated on the toner particles has dissipated.

20. A liquid toner comprising:

a dielectric carrier liquid;

toner particles that have been reacted with an organic aluminum salt that is soluble in the carrier liquid at room temperature; and a charge director, wherein the aluminum salt is effective to increase the chargeability of the toner particles by the charge director, and wherein the aluminum salt is $Al(TR)_3$ (aluminum tri di-tridecylsulfosuccinate).

21. A liquid toner according to claim 20 wherein the carrier liquid is a liquid hydrocarbon.

22. A liquid toner according to claim 21 wherein the carrier liquid is an isoparaffin.

23. A liquid toner according to claim 20 wherein the salt has a solubility in the carrier liquid greater than or equal to about 2% w/w.

24. A liquid toner according to claim 20 wherein the salt has a solubility in the carrier liquid greater than or equal to about 5% w/w.

25. A liquid toner according to claim 20 wherein the charge director comprises at least one of the group consisting of basic barium petronate (BBP), calcium petronate and a zwitterionic material.

* * * * *